US010062229B2

(12) United States Patent
Zeinstra

(10) Patent No.: US 10,062,229 B2
(45) Date of Patent: Aug. 28, 2018

(54) INTEGRATED GARAGE DOOR OPENER FOR CONNECTED VEHICLE

(71) Applicant: Faraday&Future Inc., Gardena, CA (US)

(72) Inventor: Mark Lewis Zeinstra, Holland, MI (US)

(73) Assignee: FARADAY & FUTURE INC., Gardena, CA (US)

( * ) Notice: Subject to any disclaimer, the term of this patent is extended or adjusted under 35 U.S.C. 154(b) by 0 days.

(21) Appl. No.: 15/582,491

(22) Filed: Apr. 28, 2017

(65) Prior Publication Data

US 2017/0316630 A1 Nov. 2, 2017

Related U.S. Application Data

(60) Provisional application No. 62/329,585, filed on Apr. 29, 2016.

(51) Int. Cl.
*G07C 9/00* (2006.01)

(52) U.S. Cl.
CPC .... *G07C 9/00182* (2013.01); *E05Y 2900/106* (2013.01); *G07C 2009/00769* (2013.01); *G07C 2009/00928* (2013.01)

(58) Field of Classification Search
CPC ..... G07C 9/00182; G07C 2009/00769; G07C 2009/00928; E05Y 2900/106
USPC ..... 340/5.71
See application file for complete search history.

(56) References Cited

U.S. PATENT DOCUMENTS 6,707,391 B1 * 3/2004 Monroe ..... G08G 1/0965 340/901
8,208,888 B2 * 6/2012 Chutorash ..... G07C 9/00309 455/352
8,970,352 B2 * 3/2015 Holt ..... G07C 9/00309 340/12.24
2012/0043935 A1 * 2/2012 Dyer ..... B60L 1/003 320/109
2015/0284219 A1 * 10/2015 McConnell ..... B60P 3/12 414/680
2015/0302738 A1 * 10/2015 Geerlings ..... G08C 17/02 340/5.25

* cited by examiner

*Primary Examiner* — Steven Lim
*Assistant Examiner* — Mancil Littlejohn, Jr.
(74) *Attorney, Agent, or Firm* — Skyler R. Lund

(57) ABSTRACT

A vehicle is disclosed. The vehicle includes integrated garage door opener electronics including one or more antennas, and a processor coupled to the integrated garage door opener electronics and in communication with a touch screen. The processor is configured to detect, at the one or more antennas, a garage door opener signal from a garage door opener transmitter, determine, based on the detected garage door opener signal, one or more characteristics of a respective garage door opener associated with the garage door opener transmitter, and in accordance with a determination that instructions for programming the integrated garage door opener electronics to operate the respective garage door opener are available, display, on the touch screen, the instructions for programming the integrated garage door opener electronics to operate the respective garage door opener.

12 Claims, 3 Drawing Sheets

INTEGRATED GARAGE DOOR OPENER FOR CONNECTED VEHICLE

CROSS-REFERENCE TO RELATED APPLICATIONS

This application claims the benefit of U.S. Provisional Application No. 62/329,585, filed Apr. 29, 2016, the entirety of which is hereby incorporated by reference.

FIELD OF THE DISCLOSURE

This relates generally to electronics programmable to operate a garage door, and more particularly, to integrated garage door opener electronics in a connected vehicle that facilitate easy operation and/or programming.

BACKGROUND OF THE DISCLOSURE

Vehicles can include integrated electronics for operating one or more garage doors. However, user experience with operating and/or programming these integrated electronics can be cumbersome, potentially requiring the user to enter and exit the vehicle multiple times when programming the electronics, and providing minimal feedback to the user. Therefore, there exists a need for improved electronics in a vehicle for operating one or more garage doors.

SUMMARY OF THE DISCLOSURE

Examples of the disclosure are directed to an improved integrated garage door opener system in a vehicle that can operate with a touch screen on the vehicle, and/or with a separate electronic device, such as a smartphone.

DETAILED DESCRIPTION

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

Vehicles can include integrated electronics for operating one or more garage doors. However, user experience with operating and/or programming these integrated electronics can be cumbersome, potentially requiring the user to enter and exit the vehicle multiple times when programming the electronics, and providing minimal feedback to the user. Examples of the disclosure are directed to an improved integrated garage door opener system in a vehicle that can operate with a touch screen on the vehicle, and/or with a separate electronic device, such as a smartphone.

Figure 1:
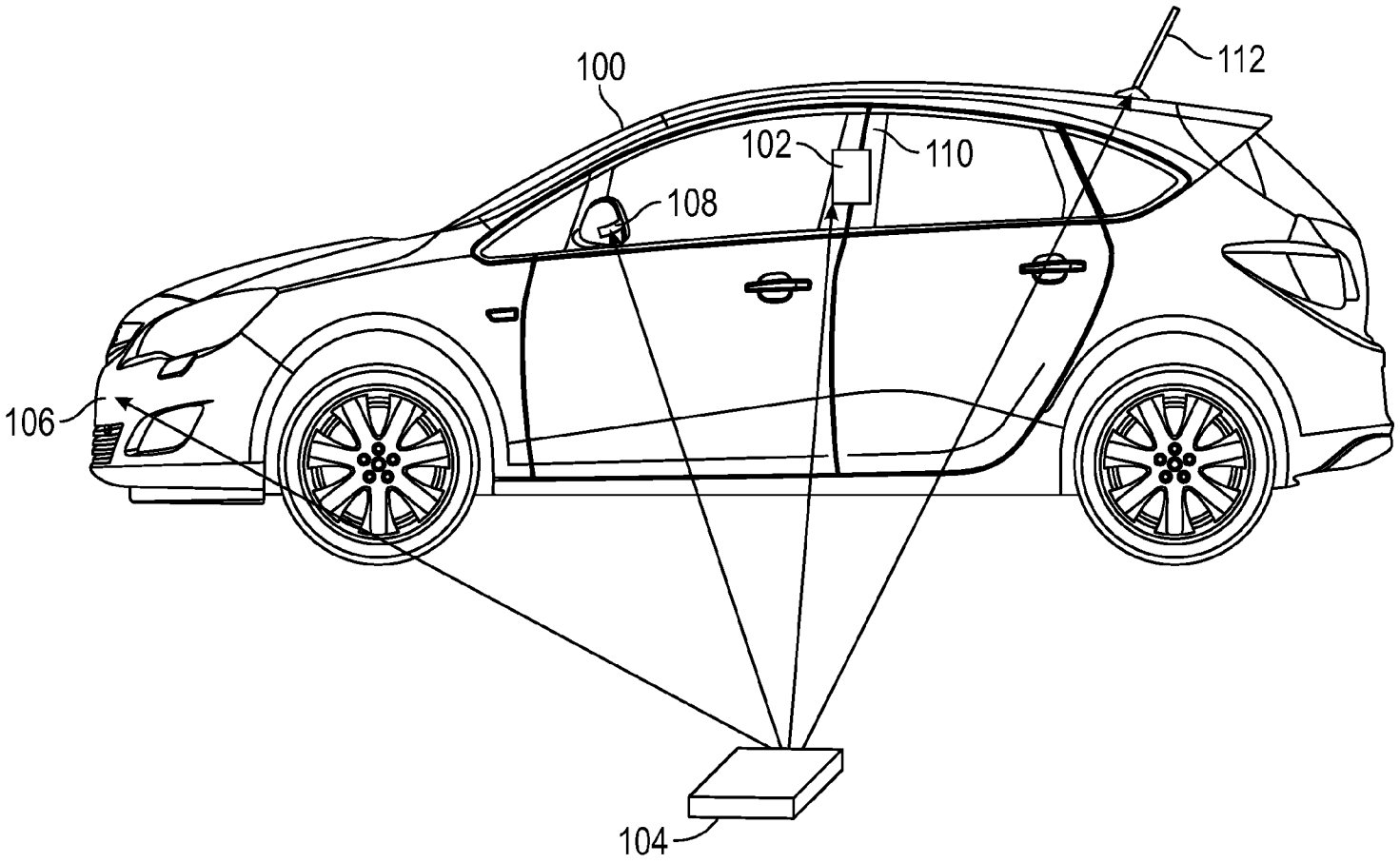
FIG. 1 illustrates an exemplary vehicle with integrated garage door opener electronics according to examples of the disclosure.

FIG. 1 illustrates an exemplary vehicle 100 with integrated garage door opener electronics 104 according to examples of the disclosure. Vehicle 100 can be an automobile, a motorcycle, or any other vehicle that can include integrated electronics for operating a garage door (or other wirelessly-controlled devices, such as wireless lighting systems). Vehicle 100 can include integrated garage door opener electronics 104, which can include various components such as electronic housings and one or more antennas (e.g., for transmitting and/or receiving garage door opener signals). Various components of the integrated garage door opener electronics 104 can be integrated with and/or packaged on one or more exterior surfaces of vehicle 100 to provide for improved radio frequency (RF) transmission performance for the garage door opener system. For example, one or more antennas in the garage door opener electronics 104 can be integrated in the front bumper 106 of vehicle 100, in one or both side mirrors 108 of the vehicle and/or in a roof-mounted antenna 112 of the vehicle. Additionally, vehicle 100 can include touch screen 102, which in some examples, can be externally mounted (e.g., mounted so as to display towards the outside of the vehicle) on a B-pillar 110 of the vehicle. Touch screen 102 can be used to operate and/or program the integrated garage door opener system of vehicle 100, as will be described in more detail below. In some examples, touch screen 102 can be mounted so as to be within a threshold distance (e.g., two feet, three feet, five feet, or an arm's length) of one or more external garage door opener antenna mounting locations on vehicle 100, so that a user programming the garage door opener system can have easy access to the touch screen and the one or more external garage door opener antennas concurrently, as will be described in more detail below. In some examples, vehicle 100 can be a "connected" vehicle that can be in communication with one or more electronic devices and/or the internet (e.g., via a cellular, Wi-Fi, Bluetooth, and/or other wired or wireless connection).

Figure 2:
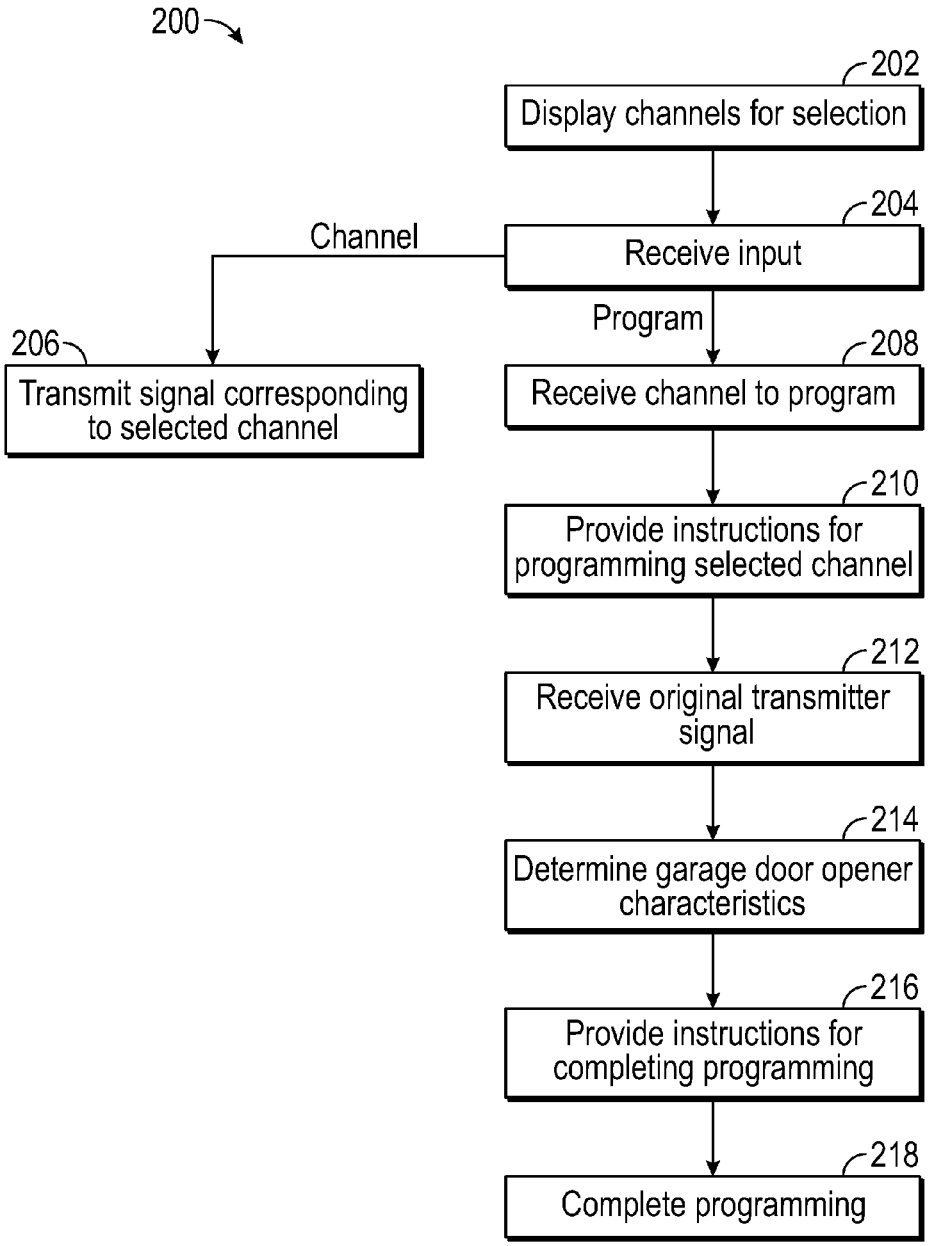
FIG. 2 illustrates a method of operating and/or programming the integrated garage door opener electronics of the disclosure.

In some examples, touch screen 102 can be used to operate and/or program the integrated garage door opener electronics of the disclosure. Additionally, in some examples, any other electronic device, such as a smartphone, that includes a display/touch screen and is in communication (e.g., wireless or otherwise) with vehicle 100 can be used to operate and/or program the integrated garage door opener electronics of the disclosure. FIG. 2 illustrates a method 200 of operating and/or programming the integrated garage door opener electronics of the disclosure. As previously mentioned, method 200 can be performed at vehicle 100 using touch screen 102 as a display and input device, and/or using another electronic device (e.g., a smartphone) that has a display/touch screen as a display and input device and with which vehicle 100 is in communication. However, method 200 will be described as being performed at vehicle 100 using touch screen 102, for ease of description.

At 202, the integrated garage door opener electronics of the disclosure can operate in a normal operating mode, during which touch screen 102 can display one or more buttons/channels that can be selected to transmit different wireless signals via the antenna(s) of the integrated garage door opener electronics to, for example, open or close different garage doors (e.g., three buttons, one for each of a first garage door, a second garage door and a third garage door). In some examples, the integrated garage door opener electronics of the disclosure can be in communication (e.g., wireless communication) with one or more garage door openers, which can provide information to the integrated garage door opener electronics about the current state of their corresponding garage doors (e.g., whether they are open or closed). At 202, touch screen 102 can also display such state information about the garage doors it is programmed to control, such as displaying information that the garage door associated with a first button is open, while displaying information that the garage door associated with a second button is closed.

At 204, user input can be received at touch screen 102. If the input is a selection of a garage door button/channel displayed at 202, at 206, the integrated garage door opener electronics of the disclosure can transmit a signal corresponding to the selected button via the antenna(s) of the integrated garage door opener electronics to open or close the corresponding garage door. Further, the integrated garage door opener electronics can remain in the normal operating mode at 206, and the one or more buttons displayed at 202 can continue to be displayed on touch screen 102.

If the input received at 204 is an input to program the integrated garage door opener electronics (e.g., selection of a "settings" button on touch screen 102), at 208, the integrated garage door opener electronics can transition from the normal operating mode to a programming operating mode. While in the programming operating mode, touch screen 102 can display a prompt requesting user selection of a button/channel that the user wishes to program, and can also display the buttons/channels that are available for programming (e.g., three buttons, as described above). In some examples, touch screen 102 can display visual indications of which buttons/channels have already been programmed, and which buttons/channels have not yet been programmed (e.g., a first button can be displayed with an indication that it has been programmed to a first garage door, while a second button can be displayed with an indication that it has not yet been programmed). Further, at 208, touch screen 102 can receive user input selecting one of the displayed buttons/channels to program.

At 210, in response to receiving the input selecting a given button/channel to program, touch screen 102 can display graphical instructions showing how to program the selected button/channel. These instructions can include an instruction for the user to activate (e.g., cause to transmit) and hold the original transmitter for the garage door being programmed near one or more antennas of the integrated garage door opener electronics (e.g., near one or more of the front bumper 106 of vehicle 100, in one or both side mirrors 108 of the vehicle and/or in a roof-mounted antenna 112 of the vehicle), so that the integrated garage door opener electronics can detect the signal being transmitted from the original transmitter at 212, and can train its transmitters to transmit the same signal, or a corresponding signal, as the original transmitter. A garage door opener transmitter can be an electronic device that includes antenna(s) and/or circuitry configurable to transmit a garage door opener signal (e.g., a wireless signal, such as a radio frequency (RF) signal having a particular frequency characteristic) to a garage door opener to cause the garage door opener to perform a function corresponding to the transmitted garage door opener signal (e.g., open a corresponding garage door). Further, a garage door opener can be a device that is coupled to a garage door, and includes a mechanism (e.g., belts, gearing, etc.) for opening and closing the garage door.

In some examples, based on the signal received from the original transmitter at 212, at 214, the integrated garage door opener electronics can determine one or more characteristics (e.g., a make and/or model) of the garage door opener that is associated with the original transmitter (e.g., the garage door opener that the original transmitter is programmed to operate). For example, the signal generated by the original transmitter may have a frequency and/or rolling code format that corresponds to a given make or model of garage door opener. The integrated garage door opener electronics can detect this frequency and/or rolling code format, and can, through a lookup table or other index stored on vehicle 100 (or via a connection to the internet), automatically determine the make or model of the garage door opener in question based on the detected frequency and/or rolling code format (e.g., without requiring manual user input identifying the make or model of the garage door opener). The integrated garage door opener electronics can further, based on the determined characteristics of the garage door opener, automatically retrieve (e.g., from storage on vehicle 100, or via a connection to the internet) specific instructions for programming the integrated garage door opener electronics to work with the garage door opener in question, rather than generic instructions for programming the integrated garage door opener electronics to work with any generic garage door opener. A generic garage door opener can be any garage door opener as opposed to a specific model, brand, and/or type of garage door opener.

At 216, instructions for completing the programming of the selected button/channel at 208 can be displayed on touch screen 102. These instructions can include instructions specific to the garage door opener associated with the original transmitter, if such instructions were found at 214, and/or generic instructions for programming the integrated garage door opener electronics. For example, if the integrated garage door opener electronics determines that the original transmitter is associated with a first garage door opener, a first set of instructions for programming the selected button/channel can be displayed on touch screen 102, and if the integrated garage door opener electronics determines that the original transmitter is associated with a second garage door opener, a second set of instructions, different from the first set of instructions, for programming the selected button/channel can be displayed on the touch screen. Additionally, in some examples, if the integrated garage door opener electronics is not able to determine that the original transmitter is associated with a specific garage door opener, and/or if instructions for a specific garage door opener are not found, a generic set of instructions (e.g., not specific to a particular garage door opener) for programming the selected button/channel can be displayed on touch screen 102.

At 218, programming of the button/channel selected at 208 can be complete, and the integrated garage door opener electronics can return to the normal operating mode, and touch screen 102 can display one or more buttons/channels that can be selected to transmit different wireless signals to open or close different garage doors, for example. As previously stated, method 200 can additionally or alternatively be performed using an electronic device, separate from vehicle 100 (e.g., a smartphone or equivalent device), that is in communication with the vehicle (e.g., via a cellular, Wi-Fi, Bluetooth, or other wired or wireless connection) as a display and input device. Such flexibility gives the user freedom to move away from the vehicle, as needed, while maintaining access to the integrated garage door opener electronics programming process described above. Further, because steps 202, 204 and 206 can be performed using the electronic device, separate from vehicle 100, a user can open or close a garage door (e.g., by selecting a corresponding button at 204) from the electronic device, without needing to be in or near the vehicle.

Figure 3:
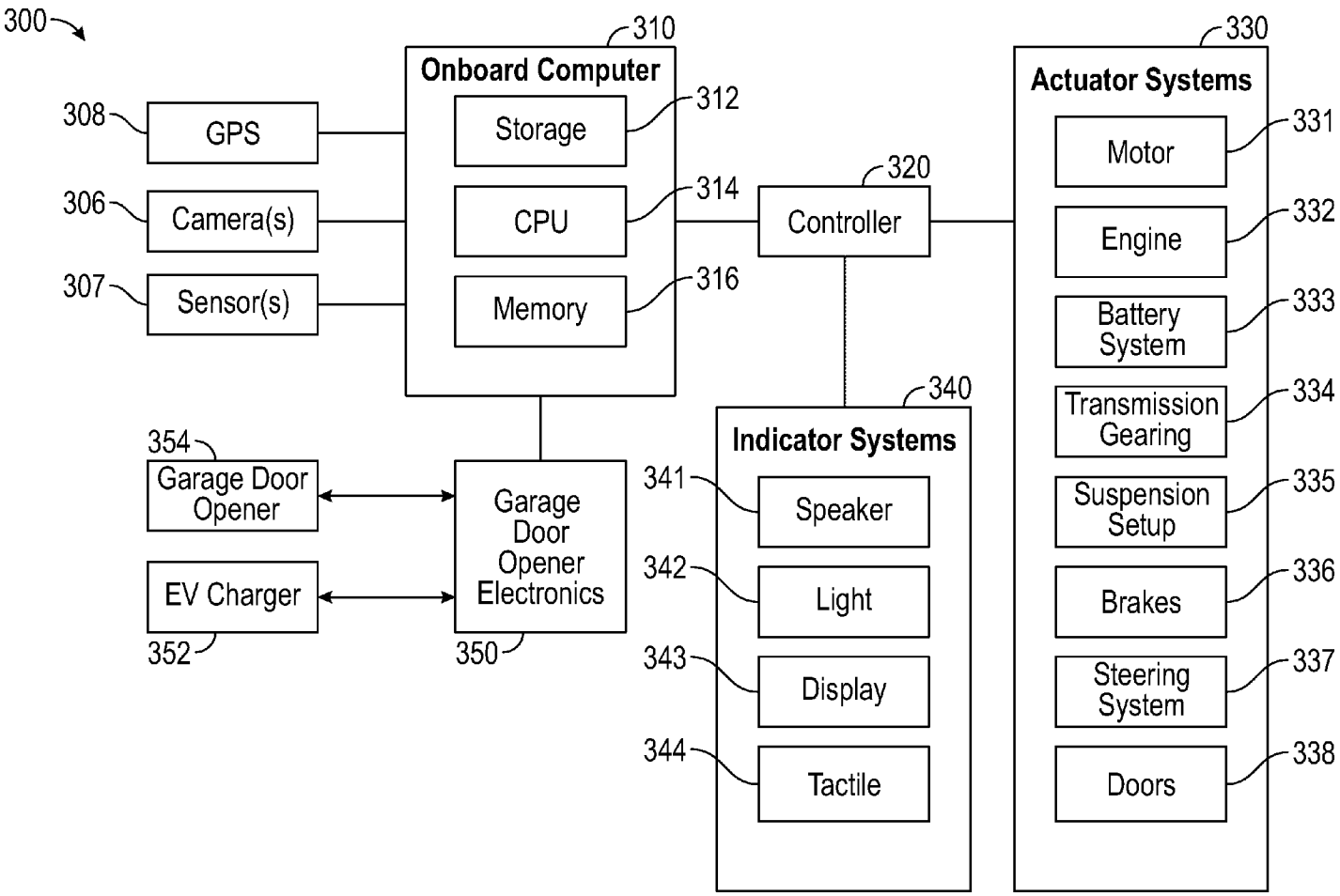
FIG. 3 illustrates an exemplary system block diagram of a vehicle control system according to examples of the disclosure.

FIG. 3 illustrates an exemplary system block diagram of vehicle control system 300 according to examples of the disclosure. Vehicle control system 300 can perform any of the methods described with reference to FIGS. 1-2. System 300 can be incorporated into a vehicle, such as a consumer automobile. Other example vehicles that may incorporate the system 300 include, without limitation, airplanes, boats, motorcycles or industrial automobiles. Vehicle control system 300 can include one or more cameras 306 capable of capturing image data (e.g., video data) for determining various characteristics of the vehicle's surroundings. Vehicle control system 300 can also include one or more other sensors 307 (e.g., radar, ultrasonic, LIDAR, etc.) capable of detecting various characteristics of the vehicle's surroundings, and a Global Positioning System (GPS) receiver 308 capable of determining the location of the vehicle.

Vehicle control system 300 can also include integrated garage door opener electronics 350, as previously described. Integrated garage door opener electronics 350 can be in communication (e.g., via a cellular, Wi-Fi, Bluetooth, or other wired or wireless connection) with one or more garage door openers 354. This communication can include signals transmitted from garage door opener electronics 350 to the one or more garage door openers 354 (e.g., signals to open or close their corresponding garage doors), and/or signals transmitted from the one or more garage door openers to the garage door opener electronics in system 300 (e.g., signals about the states of the garage doors controlled by the garage door openers). Further, in some examples, the one or more garage door openers 354 can transmit, to integrated garage door opener electronics 350, information about the states of optical safety beams that might be in communication with the garage door openers, which can provide information to the garage door openers about whether an object is in the way of closing their corresponding garage doors (and thus interfering with the optical safety beams). Integrated garage door opener electronics 350 can use this information to display appropriate indications on touch screen 102 (or on a display of another electronic device) of such status (e.g., an indication that the garage door corresponding to a given button cannot be closed, because an object is interfering with the garage door). In some examples, system 300 can use this information to aid the vehicle in performing various operations, such as autonomous driving procedures (e.g., autonomous self-parking in the garage). For example, the vehicle can utilize knowledge about when its tires interfere with the optical safety beams of a garage door opener to gain additional information about the vehicle's position in the garage. In some examples, the one or more garage door openers 354 can include additional sensors (e.g., one or more cameras) that the vehicle can similarly utilize to enhance vehicle operation as a result of being in communication with the one or more garage door openers.

Further, in some examples, the communication between integrated garage door opener electronics 350 and the one or more garage door openers 354 can allow the integrated garage door opener electronics to determine whether the vehicle is in range of operating the garage door opener(s) it is programmed to operate (e.g., by determining whether or not the integrated garage door opener electronics is able to establish a communication link with the garage door opener(s), and/or based on the GPS location of the vehicle and known location(s) of the garage door opener(s)). If integrated garage door opener electronics 350 determines that the vehicle is not in range of operating one or more garage door openers it is programmed to operate, it can stop displaying buttons/channels corresponding to those garage door openers on touch screen 102, for example. Once integrated garage door opener electronics 350 determines that the vehicle is in range of operating the above-mentioned one or more garage door openers it is programmed to operate, it can resume displaying buttons/channels corresponding to those garage door openers on touch screen 102, for example. Additionally, in the manners described above, integrated garage door opener electronics 350 can determine that the vehicle is in range of a garage door opener that it is not programmed to operate, and can display a visual indication on touch screen 102 indicating as much and give a user an option to program a button/channel to operate that garage door opener.

In some examples, integrated garage door opener electronics 350 can be in communication (e.g., via a cellular, Wi-Fi, Bluetooth, or other wired or wireless connection) with one or more electric vehicle charging stations 352 in a garage. Such charging stations 352 may include a display, which can, as a result of the communication with integrated garage door opener electronics 350, display one or more buttons/channels that can be selected to open or close the garage door. Upon selection of such a button/channel, the one or more electric vehicle charging stations 352 can transmit, to integrated garage door opener electronics 350, information about the selected button/channel. In response, integrated garage door opener electronics 350 can transmit the appropriate signal to the one or more garage door openers 354 to cause the corresponding garage door to open or close. In this way, a user can control operation of integrated garage door opener electronics 350 via the one or more electric vehicle charging stations 352, remotely from the vehicle. One or more additional aspects of the operation of integrated garage door opener electronics 350 described in this disclosure can, similarly, be performed using the one or more electric vehicle charging stations 352 as displays and/or input devices.

Vehicle control system 300 can include an on-board computer 310 that is coupled to the cameras 306, sensors 307, GPS receiver 308 and integrated garage door opener electronics 350, and that is capable of receiving the image data from the cameras and/or outputs from the sensors 307, the GPS receiver 308 and the integrated garage door opener electronics 350. The on-board computer 310 can be capable of controlling operation and/or programming of integrated garage door opener electronics 350, as described in this disclosure. On-board computer 310 can include storage 312, memory 316, and a processor 314. Processor 314 can perform any of the methods described in this disclosure, including those described with reference to FIGS. 1-2. Additionally, storage 312 and/or memory 316 can store data and instructions (such as settings for operating or programming integrated garage door opener electronics 350) for performing any of the methods described in this disclosure, including those described with reference to FIGS. 1-2. Storage 312 and/or memory 316 can be any non-transitory computer readable storage medium, such as a solid-state drive or a hard disk drive, among other possibilities. The vehicle control system 300 can also include a controller 320 capable of controlling one or more aspects of vehicle operation.

In some examples, the vehicle control system 300 can be connected to (e.g., via controller 320) one or more actuator systems 330 in the vehicle and one or more indicator systems 340 in the vehicle. The one or more actuator systems 330 can include, but are not limited to, a motor 331 or engine 332, battery system 333, transmission gearing 334, suspension setup 335, brakes 336, steering system 337 and door system 338. The vehicle control system 300 can control, via controller 320, one or more of these actuator systems 330 during vehicle operation; for example, to open or close one or more of the doors of the vehicle using the door actuator system 338, to control the vehicle during autonomous driving or parking operations using the motor 331 or engine 332, battery system 333, transmission gearing 334, suspension setup 335, brakes 336 and/or steering system 337, etc. The one or more indicator systems 340 can include, but are not limited to, one or more speakers 341 in the vehicle (e.g., as part of an entertainment system in the vehicle), one or more lights 342 in the vehicle, one or more displays 343 in the vehicle (e.g., as part of a control or entertainment system in the vehicle, and/or as part of the integrated garage door opener electronics of the disclosure, such as touch screen 102) and one or more tactile actuators 344 in the vehicle (e.g., as part of a steering wheel or seat in the vehicle). The vehicle control system 300 can control, via controller 320, one or more of these indicator systems 340 to provide indications to a user of the vehicle of the operation or programming of integrated garage door opener electronics 350 controlled by the on-board computer 310 (e.g., to alert the user that programming of the integrated garage door opener electronics is complete).

Thus, the examples of the disclosure provide enhanced architecture and operation for an integrated garage door opener in a connected vehicle.

Therefore, according to the above, some examples of the disclosure are directed to a vehicle comprising: integrated garage door opener electronics including one or more antennas; and a processor coupled to the integrated garage door opener electronics and in communication with a touch screen, the processor configured to: detect, at the one or more antennas, a garage door opener signal from a garage door opener transmitter; determine, based on the detected garage door opener signal, one or more characteristics of a respective garage door opener associated with the garage door opener transmitter; and in accordance with a determination that instructions for programming the integrated garage door opener electronics to operate the respective garage door opener are available, display, on the touch screen, the instructions for programming the integrated garage door opener electronics to operate the respective garage door opener. Additionally or alternatively to one or more of the examples disclosed above, in some examples, the touch screen is mounted on an exterior of the vehicle. Additionally or alternatively to one or more of the examples disclosed above, in some examples, the touch screen is included in an electronic device, separate from the vehicle, that is in communication with the vehicle. Additionally or alternatively to one or more of the examples disclosed above, in some examples, the touch screen is included in a charging station configured to charge the vehicle. Additionally or alternatively to one or more of the examples disclosed above, in some examples, the determination that the instructions for programming the integrated garage door opener electronics to operate the respective garage door opener are available comprises automatically identifying, based on the determined one or more characteristics of the respective garage door opener, the instructions for programming the integrated garage door opener electronics to operate the respective garage door opener. Additionally or alternatively to one or more of the examples disclosed above, in some examples, the processor is further configured to: display, on the touch screen, generic instructions for programming the integrated garage door opener electronics to operate a generic garage door opener in response to a determination that the instructions for programming the integrated garage door opener electronics to operate the respective garage door opener are not available. Additionally or alternatively to one or more of the examples disclosed above, in some examples, the processor is further configured to: receive, from the respective garage door opener, one or more signals indicative of a state of the respective garage door opener; and display, on the touch screen, a visual indication of the state of the respective garage door opener. Additionally or alternatively to one or more of the examples disclosed above, in some examples, the state of the respective garage door opener comprises one or more of a garage door associated with the respective garage door opener being open, and the garage door being closed. Additionally or alternatively to one or more of the examples disclosed above, in some examples, the state of the respective garage door opener comprises one or more of an object interfering with closing of a garage door associated with the respective garage door opener, and no object interfering with the closing of the garage door. Additionally or alternatively to one or more of the examples disclosed above, in some examples, the integrated garage door opener electronics is programmed to operate the respective garage door opener and a second garage door opener, and the processor is further configured to: receive, from the second garage door opener, one or more signals indicative of a state of the second garage door opener; and display, on the touch screen, a visual indication of the state of the second garage door opener, independently of displaying the visual indication of the state of the respective garage door opener. Additionally or alternatively to one or more of the examples disclosed above, in some examples, the processor is further configured to: receive, from the respective garage door opener, one or more signals indicative of information from one or more sensors in communication with the respective garage door opener; and perform one or more autonomous driving operations using the one or more signals received from the respective garage door opener. Additionally or alternatively to one or more of the examples disclosed above, in some examples, the one or more autonomous driving operations comprise a self-parking operation. Additionally or alternatively to one or more of the examples disclosed above, in some examples, the integrated garage door opener electronics is programmed to operate the respective garage door opener, and the processor is further configured to: determine whether the vehicle is in range to operate the respective garage door opener; in accordance with a determination that the vehicle is in the range to operate the respective garage door opener, display, on the touch screen, a button for operating the respective garage door opener; and in accordance with a determination that the vehicle is not in the range to operate the respective garage door opener, forgo displaying the button for operating the respective garage door opener. Additionally or alternatively to one or more of the examples disclosed above, in some examples, the integrated garage door opener electronics is not programmed to operate a second garage door opener, and the processor is further configured to: determine whether the vehicle is in range to operate the second garage door opener; in accordance with a determination that the vehicle is in the range to operate the second garage door opener, display, on the touch screen, a visual indication for programming the integrated garage door opener electronics to operate the second garage door opener; and in accordance with a determination that the vehicle is not in the range to operate the second garage door opener, forgo displaying the visual indication for programming the integrated garage door opener electronics to operate the second garage door opener.

Some examples of the disclosure are directed to a non-transitory computer-readable medium including instructions, which when executed by one or more processors, cause the one or more processors to perform a method comprising: detecting, at one or more antennas of integrated garage door electronics in a vehicle, a garage door opener signal from a garage door opener transmitter; determining, based on the detected garage door opener signal, one or more characteristics of a respective garage door opener associated with the garage door opener transmitter; and in accordance with a determination that instructions for programming the integrated garage door opener electronics to operate the respective garage door opener are available, displaying, on a touch screen in communication with the integrated garage door opener electronics, the instructions for programming the integrated garage door opener electronics to operate the respective garage door opener.

Some examples of the disclosure are directed to a method comprising: detecting, at one or more antennas of integrated garage door electronics in a vehicle, a garage door opener signal from a garage door opener transmitter; determining, based on the detected garage door opener signal, one or more characteristics of a respective garage door opener associated with the garage door opener transmitter; and in accordance with a determination that instructions for programming the integrated garage door opener electronics to operate the respective garage door opener are available, displaying, on a touch screen in communication with the integrated garage door opener electronics, the instructions for programming the integrated garage door opener electronics to operate the respective garage door opener.

Although examples of this disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

The invention claimed is:

1. A vehicle comprising:

integrated garage door opener electronics including one or more antennas, wherein the integrated garage door opener electronics is programmed to operate the respective garage door opener; and a processor coupled to the integrated garage door opener electronics and in communication with a touch screen, the processor configured to:

detect, at the one or more antennas, a garage door opener signal from a garage door opener transmitter;

determine, based on the detected garage door opener signal, one or more characteristics of the respective garage door opener associated with the garage door opener transmitter;

in accordance with a determination that instructions for programming the integrated garage door opener electronics to operate the respective garage door opener are available, display, on the touch screen, the instructions for programming the integrated garage door opener electronics to operate the respective garage door opener;

determine whether the vehicle is in range to operate the respective garage door opener;

in accordance with a determination that the vehicle is in the range to operate the respective garage door opener, display, on the touch screen, a button for operating the respective garage door opener; and in accordance with a determination that the vehicle is not in the range to operate the respective garage door opener, forgo displaying the button for operating the respective garage door opener.

2. The vehicle of claim 1, wherein the determination that the instructions for programming the integrated garage door opener electronics to operate the respective garage door opener are available comprises automatically identifying, based on the determined one or more characteristics of the respective garage door opener, the instructions for programming the integrated garage door opener electronics to operate the respective garage door opener.

3. The vehicle of claim 1, wherein the processor is further configured to:

display, on the touch screen, generic instructions for programming the integrated garage door opener electronics to operate a generic garage door opener in response to a determination that the instructions for programming the integrated garage door opener electronics to operate the respective garage door opener are not available.

4. The vehicle of claim 1, wherein the touch screen is mounted on an exterior of the vehicle.

5. The vehicle of claim 1, wherein the touch screen is included in an electronic device, separate from the vehicle, that is in communication with the vehicle.

6. The vehicle of claim 1, wherein the touch screen is included in a charging station configured to charge the vehicle.

7. The vehicle of claim 1, wherein the processor is further configured to:

receive, from the respective garage door opener, one or more signals indicative of a state of the respective garage door opener; and display, on the touch screen, a visual indication of the state of the respective garage door opener.

8. The vehicle of claim 7, wherein the state of the respective garage door opener comprises one or more of a garage door associated with the respective garage door opener being open, and the garage door being closed.

9. The vehicle of claim 7, wherein the state of the respective garage door opener comprises one or more of an object interfering with closing of a garage door associated with the respective garage door opener, and no object interfering with the closing of the garage door.

10. The vehicle of claim 7, wherein the integrated garage door opener electronics is programmed to operate the respective garage door opener and a second garage door opener, and the processor is further configured to:

receive, from the second garage door opener, one or more signals indicative of a state of the second garage door opener; and display, on the touch screen, a visual indication of the state of the second garage door opener, independently of displaying the visual indication of the state of the respective garage door opener.

11. A vehicle comprising:

integrated garage door opener electronics including one or more antennas; and a processor coupled to the integrated garage door opener electronics and in communication with a touch screen, the processor configured to:

detect, at the one or more antennas, a garage door opener signal from a garage door opener transmitter;

determine, based on the detected garage door opener signal, one or more characteristics of a respective garage door opener associated with the garage door opener transmitter; and in accordance with a determination that instructions for programming the integrated garage door opener electronics to operate the respective garage door opener are available, display, on the touch screen, the instructions for programming the integrated garage door opener electronics to operate the respective garage door opener;

receive, from the respective garage door opener, one or more signals indicative of information from one or more sensors in communication with the respective garage door opener; and perform one or more autonomous driving operations using the one or more signals received from the respective garage door opener, the one or more autonomous driving operations comprising a self-parking operation.

12. A vehicle comprising:

integrated garage door opener electronics including one or more antennas; and a processor coupled to the integrated garage door opener electronics and in communication with a touch screen, the processor configured to:

detect, at the one or more antennas, a garage door opener signal from a garage door opener transmitter;

determine, based on the detected garage door opener signal, one or more characteristics of a respective garage door opener associated with the garage door opener transmitter; and in accordance with a determination that instructions for programming the integrated garage door opener electronics to operate the respective garage door opener are available, display, on the touch screen, the instructions for programming the integrated garage door opener electronics to operate the respective garage door opener;

wherein the integrated garage door opener electronics is not programmed to operate a second garage door opener, and the processor is further configured to:

determine whether the vehicle is in range to operate the second garage door opener;

in accordance with a determination that the vehicle is in the range to operate the second garage door opener, display, on the touch screen, a visual indication for programming the integrated garage door opener electronics to operate the second garage door opener; and in accordance with a determination that the vehicle is not in the range to operate the second garage door opener, forgo displaying the visual indication for programming the integrated garage door opener electronics to operate the second garage door opener.

* * * * *